US005688172A

United States Patent [19]

Lorenzo Regidor

[11] Patent Number: 5,688,172

[45] Date of Patent: Nov. 18, 1997

[54] GAMING MACHINE REEL MOUNTING ASSEMBLY

[75] Inventor: Angel Lorenzo Regidor, Sant Climent de Llobregat, Spain

[73] Assignee: Industrias Lorenzo, S.A., Sant Climent de Llobregat, Spain

[21] Appl. No.: 560,488

[22] Filed: Nov. 17, 1995

[30] Foreign Application Priority Data

Nov. 18, 1994 [ES] Spain ..... 9402370

[51] Int. Cl.[6] ..... G07F 17/34

[52] U.S. Cl. ..... 463/20; 273/143 R

[58] Field of Search ..... 273/143 R; 463/20

[56] References Cited

U.S. PATENT DOCUMENTS

| | | | |
|---|---|---|---|
| 4,071,246 | 1/1978 | Hooker | 273/143 |
| 4,099,722 | 7/1978 | Rodesch et al. | 273/143 |
| 4,262,906 | 4/1981 | Heywood | 273/143 |
| 5,102,136 | 4/1992 | Heidel et al. | 273/143 R |
| 5,388,829 | 2/1995 | Holmes | 273/143 R |
| 5,423,540 | 6/1995 | Taxon | 273/143 R |

FOREIGN PATENT DOCUMENTS

| | | |
|---|---|---|
| 0069129 | 7/1949 | European Pat. Off. . |
| 0066985 | 12/1982 | European Pat. Off. . |
| 827 277 | 7/1952 | Netherlands . |
| 1471866 | 4/1977 | United Kingdom . |
| 1472704 | 5/1977 | United Kingdom . |
| 2093295 | 8/1982 | United Kingdom . |
| 2156565 | 10/1985 | United Kingdom . |
| 2182478 | 5/1987 | United Kingdom . |
| 2182478 | 9/1989 | United Kingdom . |
| 93/05484 | 3/1993 | WIPO . |

*Primary Examiner*—Benjamin H. Layno

*Attorney, Agent, or Firm*—Jacobson, Price, Holman & Stern, PLLC

[57] ABSTRACT

A mounting assembly for reels of gaming machines. The reel (6) bear on their edge around their periphery a translucent strip carrying various symbols and is driven by a driving motor (5) such as a stepper motor which is angularly adjustable with respect to the reel, integrating illumination lamps (12) on a lampshade holder (13) within the reel (6) which are also positionally adjustable with respect to said reel. The reel comprises a mounting (1) including a hollow cylinder (1*a*) concentrically placed within said reel (6) and with one of its bases open, housing inside a holder (4) of said motor (5). First means (11) and second means (11*a*) are provided to independently angularly adjust the position of said motor holder (4) and of said lampshade holder (13) with respect to said hollow cylinder (1*a*), said means being clamped on a peripheral toothing (2) of said hollow cylinder (1*a*).

12 Claims, 4 Drawing Sheets

GAMING MACHINE REEL MOUNTING ASSEMBLY

BACKGROUND OF THE INVENTION

The present invention concerns a mounting assembly especially conceived for reels of gaming machines actuated by coins or chips, of the type integrating several of said reels placed on edge side by side with their axes coaxially aligned, provided around their periphery with a translucent strip carrying various symbols, driven by a driving motor such as a stepper motor, and with illumination means within the reel. Such reels are arranged with their peripheral portion or edge bearing a symbol carrying strip behind a window forming a screen at the front of the machine by way of a display for a horizontal array of symbols or scores of different reels in order to thus establish various permutations and combinations of series of winning symbols.

Reels of gaming machines with such a general structure are described in GB-A-1471866 and GB-A-1472704, where some symbol detecting means in association with a reel driving means.

Patents GB-A-2156565, U.S. Pat. No. 4,262,906, GB-A-2182478 and WO-A-93/05484 describe gaming machine reel mounting assemblies allowing an alignment or positional adjustment of said driving stepper motor and of the interior illumination lamp sets with respect to said reel by turning them around the latter's axis as needed and so as to achieve correct adjustments, so as to be in a position to adapt a given set of reels to different machines. U.S. Pat. No. 4,071,246 describes such a reel including parts of a magnetic nature together with a detector device which in a magnetic field operation and with the aid of a control circuit allows to indicate the standstill positions of the reel. Other reels with positional detection means based on magnetic fields (such as Hall-effect detector devices) appear in patents EP-A-69129 and GB-2093295.

The different solutions adopted present nevertheless the drawback of involving in most cases the need to previously dismount at least the reels because of the difficult access to the adjusting members, taking into account that the arrayed reels are because of their explained operation placed side by side on edge and very close together, and they present as well the problem that the positional adjustment of the motor entails an indispensable and simultaneous relocation of the illumination lamp set, so that said lamps must be separately adjusted.

The invention seeks to provide a mounting assembly for said reels which solves the above-mentioned drawbacks in a very simple way and with a high accuracy, and which furthermore provides a sensibly lower global cost of the assembly because of the conception of the mounting and of the standardization of several of the pieces employed. To such an effect is to be especially pointed out the easy accessibility to carry out the different adjustment tasks (adaptation to different reels or machines) provided by the proposed assembly, since the means provided to carry out said tasks are located opposite to the boss and holder of the reel and next to the mouth opening of a central hollow body supporting the motor and the lamp set arranged within the reel. The adjustment of the motor and of the magnetic elements associated with the reel for the positional detection, as well as the positional adjustment of the illumination lamps with respect to the reel are besides totally independent thus facilitating a simpler adaptation of the assembly to different reels. Said adjustments can besides be carried out in a very simple and easy way, since the arrangement allows to act in the interspace between the edges of the reels without having to dismount any pieces and thereby guaranteeing the execution of an accurate task. All this brings about a better adaptability of the reel mounting assembly to different reels and/or gaming machines.

BRIEF SUMMARY OF THE INVENTION

This mounting assembly provides as well means to allow the adaptation (in length and diameter) of motors of different sizes and fastened whether by their front part or by their rear part, depending on the cases.

In order to prevent a sudden start and stop of the stepper motor the use of a flexible coupling has been foreseen comprising an arrangement of resilient elements between the output shaft of said motor and the connection or input in a reel boss, all this as per a common practice in the prior art referred to, among other documents, in patents U.S. Pat. No. 4,099,722 and EP-A-66985, though in an embodiment which differs from that described in said publications of prior art, i.e. based on a flexible coupling of conventional type.

The proposed mounting assembly comprises basically and as detailed in claim 1 a hollow cylinder with horizontal axis held in a high position by a mounting support, the mouth opening of said cylinder being peripherally toothed and cooperating with the also toothed pawls of two devices of identical conception which are apt to move along as many differentiated sectors of said peripheral toothing thereby moving along with them their associated elements which are respectively the reel driving stepper motor holder and the illumination lamp set holder.

Other features of the invention and the important advantages thereof will become apparent from the detailed description below.

BRIEF DESCRIPTION OF THE DRAWINGS

The invention will be now described in more detail by way of a nonlimiting example and referring to the enclosed drawings, wherein.

DETAILED DESCRIPTION

Figure 1:
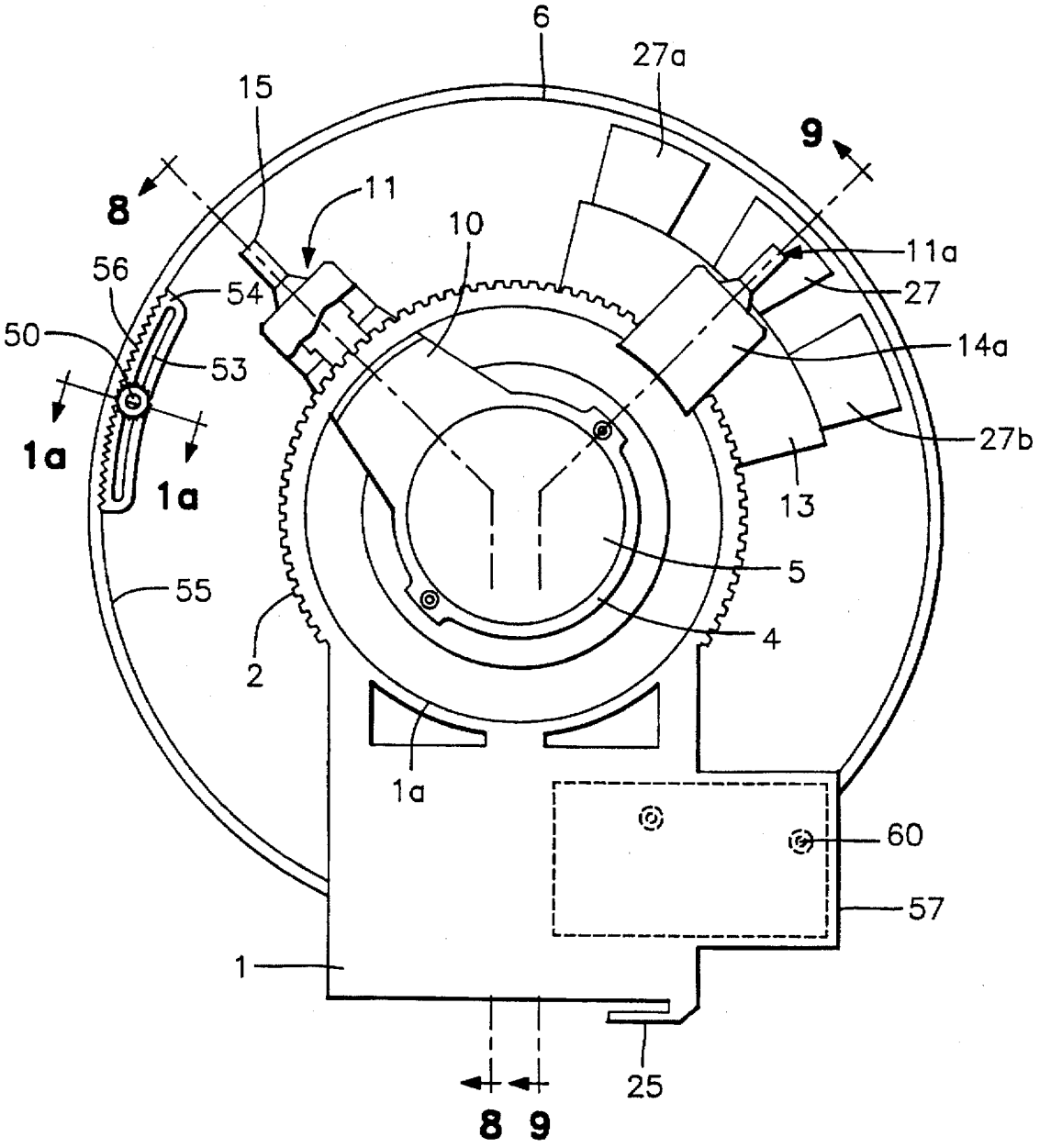
FIG. 1 is an elevational view from the rear part of a gaming machine reel mounting assembly as per the invention.

According to these FIGS., the gaming machine reel mounting assembly being the object of this patent consists in a mounting 1 in the shape of a one-piece molding comprising a vertical wall which at one of its ends is bent to thus form a lower base portion 1*b* (see FIGS. 8 and 9) with appendages 25 determining U-shaped fastening members to be associated with a sill (not shown), and which at its other end connects with the edge of the totally open base of a hollow cylinder 1*a* which has its axis in a horizontally lying position and is partially open at its other base as per circular opening 3. Cylinder la is provided at the mouth opening of its totally open base with a peripheral toothing 2, as well as with an arcuate slot 22 provided in a zone of its lateral wall. Inside said hollow cylinder 1*a* is arranged a housing 4 constituting a holder for motor 5 whose shaft extends centrally through opening 3 and bears reel 6 which is coaxially fitted on it and does in its turn peripherally bear on its edge a strip 6*a* with a given number (such as for example 12, 14 or 24) of symbols. Motor holder 4 has a bottom flange 7 surrounded by a guiding and centering cylindrical salient 21, said flange 7 being retained by means of a front stop formed by a ring 8 fastened by a screw 9 to the bottom of said hollow cylinder 1*a*.

Said motor holder 4 is besides provided with a frontal stepped tab 10 extending outside the hollow cylinder 1*a* in such a way that it flushingly matches the outline of the mouth opening of the latter and projects above its toothed rail 2. Associated with said tab 10 there is a resilient device 11 with a toothing 20 which is apt to be moved through a desired turning angle and to thus lock the assembly formed by motor holder 4 and motor once thus positioned as desired with respect to hollow cylinder 1*a*.

Figure 9:
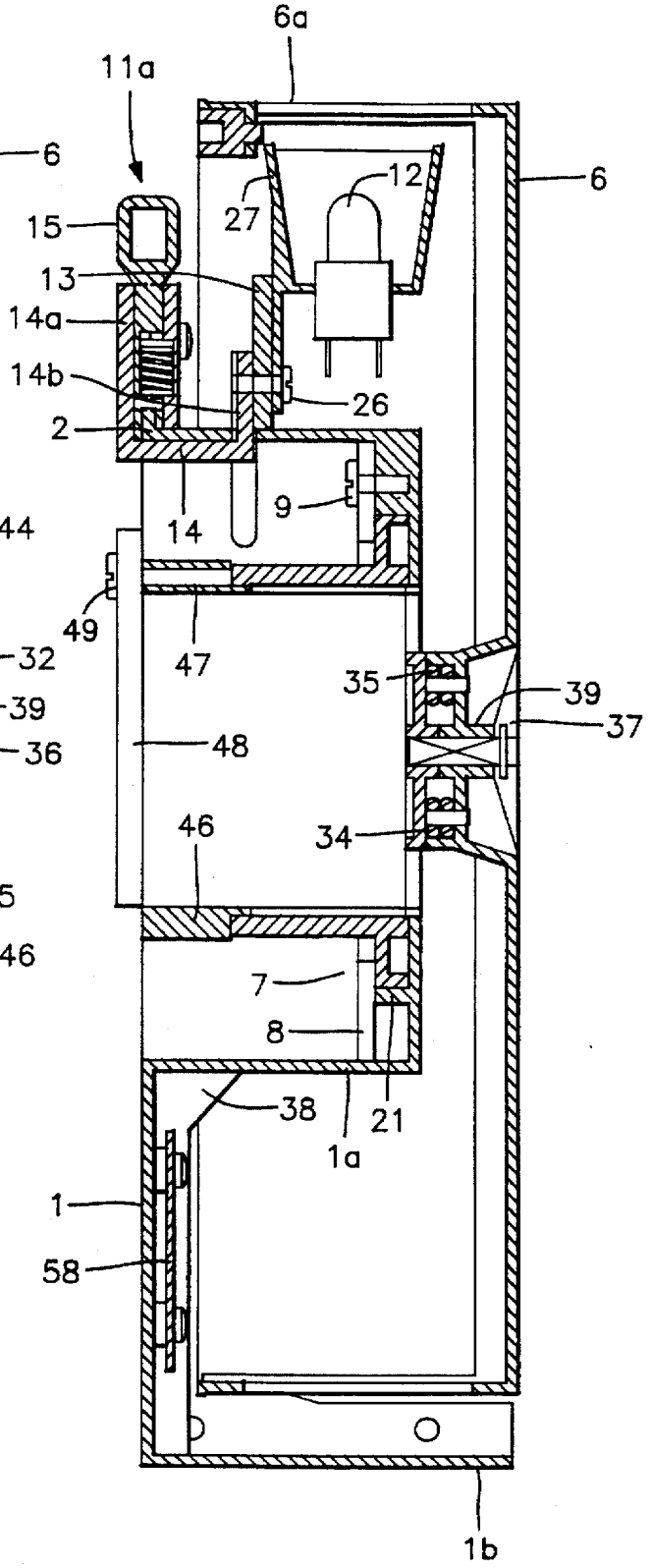
FIG. 9 is another elevational section along section line IX—IX in FIG. 1.
Figure 10:
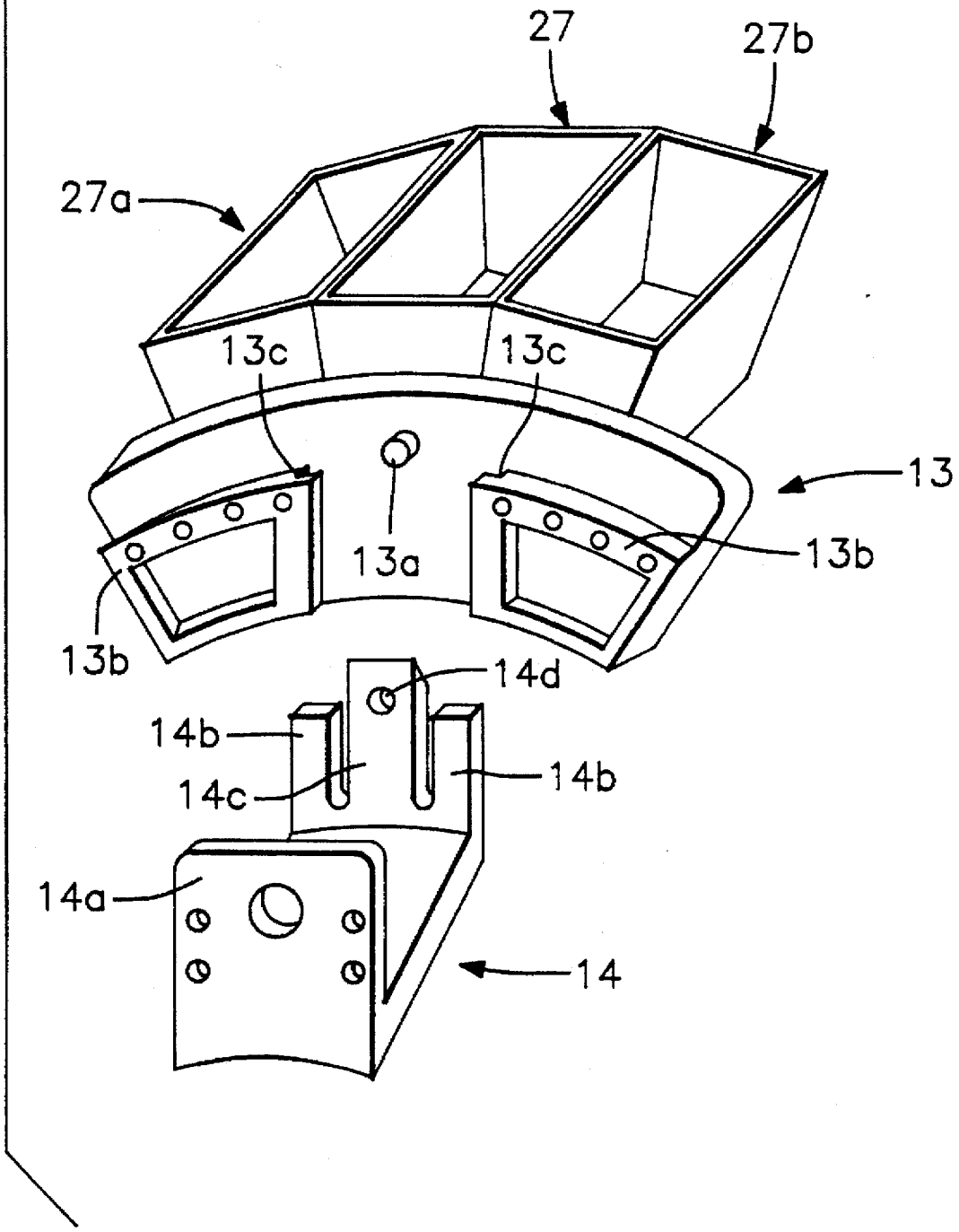
FIG. 10 is a perspective view showing the lampshade holder holding its respective lampshades, and the U-shaped piece to be attached to said lampshade holder, and allowing to appreciate a preferred way in which said attachment is to be effected.

Lamps 12 of the lamp set for the illumination of the peripheral strip 6*a* of reel 6 from inside are in their turn installed inside lampshades 27, 27*a*, 27*b* fastened to a lampshade holder 13 formed by a plate of ring-sectorial shape to be fastened by a screw (26) as in FIG. 9 or advantageously (FIG. 10) in a snap and snug fit to a U-shaped piece 14, said fastening being more precisely carried out by means of slidingly fitting the outer end parts of the inner limb portions 14*b* of the U-shaped piece 14 into the inner recesses 13*c* of lateral salients 13*b* of said ring-sectorial-shaped plate 13, and also by means of simultaneously engaging in a snap fit stub 13*a* of said plate 13 into the fitting hole 14*d* provided in the resilient inner limb central portion 14*c* of said U-shaped piece 14, said inner limb portions 14*b*, 14*c* passing in their turn through said arcuate slot 22 provided in the wall of said hollow cylinder 1*a*, a resilient device 11*a* identical to the one mentioned above being received in the parallel limb 14*a* of said U-shaped piece 14, said parallel limb 14*a* extending outside the hollow cylinder 1*a* in such a way that it flushingly matches the outline of the mouth opening of the latter and projects above its toothed rail 2, in the same way as for tab 10 but affecting in this case another sector of said toothed rail 2.

Figure 6:
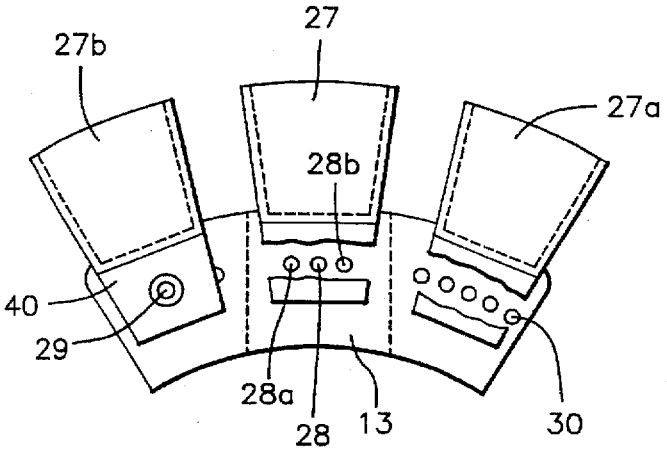
FIG. 6 is an elevational view of a holder member provided to hold the illumination elements.
Figure 7:
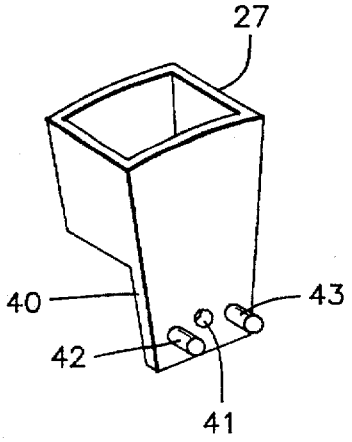
FIG. 7 shows in a perspective view one of the lampshades with a fastening lug or appendage and turn preventing means.

The illumination lamps 12 are installed inside lampshades 27, 27*a* and 27*b* each of which possesses a lug of appendage 40 formed as an extension of its bottom with a central hole 41 and two positioning, turn preventing stubs 42, 43 at each side for its fastening to said lampshade holder 13, said fastening being in the case of the central lampshade 27 carried out by means of a screw 26 passing through a hole 28 also provided in said lampshade holder 13 and flanked at both sides by holes 28*a*, 28*b* provided to receive said stubs 42, 43 of a coincident diameter. Both lateral lampshades 27*a*, 27*b* are mounted by means of screwing a screw 29 passing through hole 41 of their corresponding appendage 40 into one or another of an array of equispaced holes 30 provided in said lampshade holder 13, in such a way as to leave at each of both sides of said screw 29 a corresponding free hole for the insertion into them of the positioning stubs 42, 43. Thus in the example of FIG. 6 any of the lateral lampshades can be mounted in three alternative positions, depending on if screw 29 is arranged through the central hole 30 of the array or through any of holes 30 adjacent to said central hole, since in this way there will always be next to the chosen hole 30 another two available to receive said stubs 42, 43 provided to immobilize said lampshades.

Figure 2:
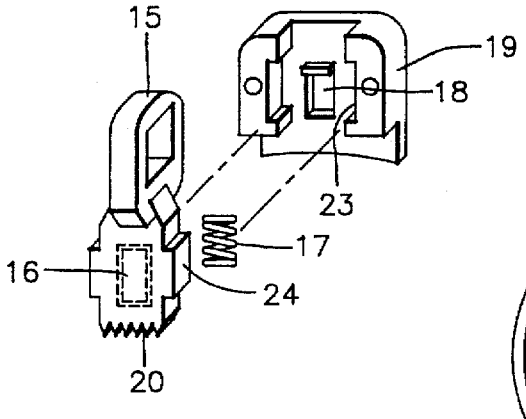
FIG. 2 is a perspective exploded view of the locking device for a releasable locking in a desired position of the reel driving motor or of the inner illumination lamp set, i.e. allowing the above-mentioned positional adjustment.

Both devices 11 and 11*a* consist of (see FIG. 2) a locking member 15 with a hollow 16 to house one half of a spring 17 whose other half is to be housed in another hollow 18 of a second piece 19 which is to be fastened in one instance to the stepped tab 10 of holder 4, and in the other instance to limb 14*a* of the U-shaped piece 14 connected to the illumination lamp set. Said second piece 19 has recesses 23 which are complementary of lateral salients 24 of said locking member but have a larger extension for thus loosely housing them. Locking member 15 ends in both cases at its end opposite to the pulling handle in a toothing 20 which is apt to snugly engage peripheral toothing 2 of hollow cylinder 1*a*.

Thus when actuating any of both devices 11, 11*a* by pulling outwards locking member 15 toothing 20 becomes disengaged from toothing 2, and motor holder 4 and/or illumination lamp set holder 13 can be then turned till reaching the desired angular position, whereupon and by means of releasing said locking member 15 the engagement is then reestablished through the action of spring 17, the whole operation taking place in a very simple and efficient way.

Figure 8:
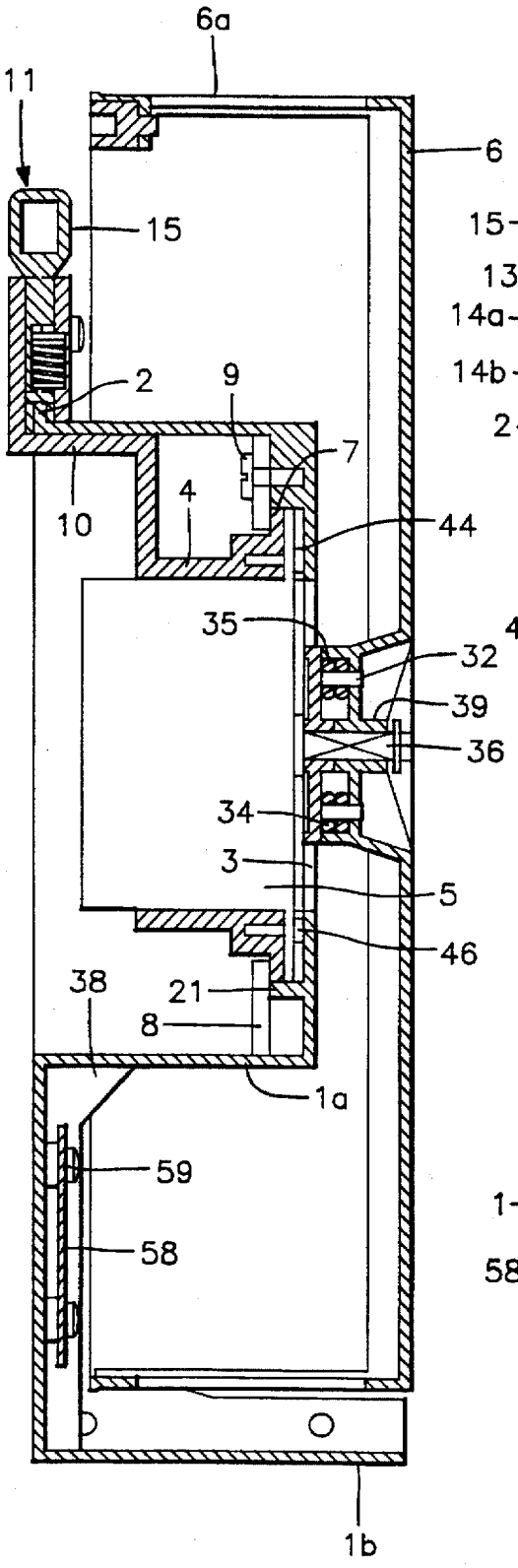
FIG. 8 is an elevational section along section line VIII—VIII in FIG. 1.

As it can be seen in FIGS. 8 and 9, between shaft 36 of motor 5 and a cylindrical boss 35 of reel 6 is arranged a resilient means such as O-rings 34 surrounding stubs or studs 32 of an intermediary piece 31 which has a central through hole 33 with a flat provided to serve as a keyway for attachment to said shaft 36 which has in its turn a longitudinal flat portion provided to serve as a key, said shaft 36 passing loosely through a central portion 39 o said boss 35 and being attached to the latter by means of a clamping washer 37. The use of an intermediary piece 31 fitted on shaft 36 and provided with several stubs around which elastic envelopes or rings are arranged which are then in their turn inserted into respective pockets of an envelope of the other piece to be attached is a typical example of an elastic coupling and is described, for instance, in patent DE-827277.

Figure 3:
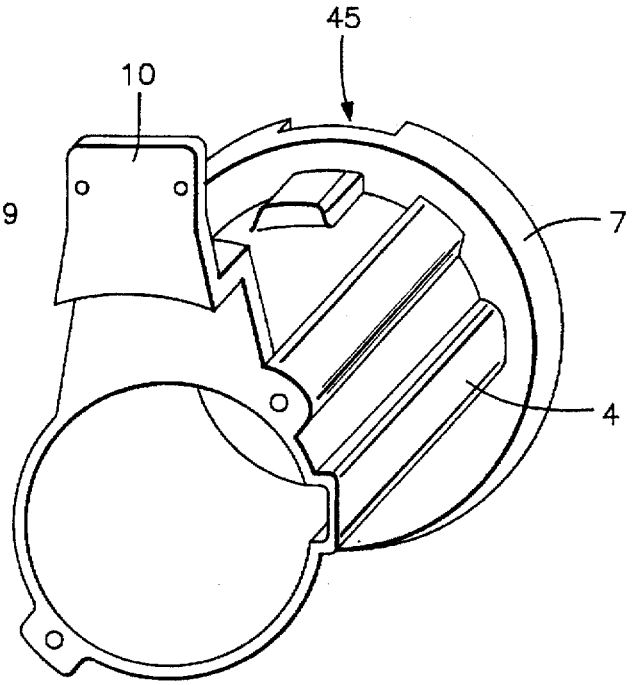
FIG. 3 is another perspective view showing the holder provided to hold and support said reel driving stepper motor.
Figure 4:
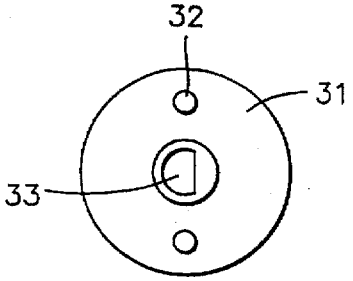
FIGS. 4 and 5 are respectively a plan-view and a sectioned side elevation of an intermediary piece which is to be provided between the motor and the reel and is apt to receive resilient means provided to constitute a flexible coupling between motor and reel.
Figure 5:
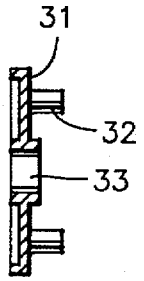

FIG. 8 shows the mounting of a motor 5 fastened by its front part by means of mounting lugs 44 extending through diametrically opposed notches 45 of flange 7 (see FIG. 3) and by means of screws 46 screwed into threaded holes of said flange 7 (FIG. 8). As an alternative, FIG. 9 shows the fastening of another motor 5*a* of larger size fastened by its rear part by means of the arrangement of an adapter tube 46 surrounding the protruding portion of said motor 5*a* and engaging with its front part with a lesser wall thickness the mouth opening of holder 4, said adapter tube comprising threaded holes 47 for fastening a back plate 48 of said motor by means of screws 49.

Figure 1A:
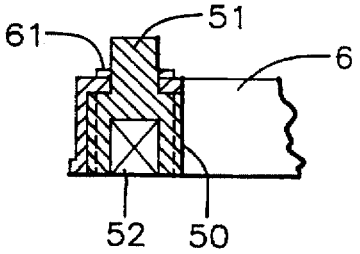
FIG. 1*a* is a section along section line 1*a*—1*a* in FIG. 1 showing a detail of the magnetic element adjustably associated with the reel for a positional indication.

FIGS. 1 and 1*a* show besides in detail the arrangement in association with reel 6 of at least a hollow pinion 50 provided at one end with a stem 51 and at its other end with a cavity to house a magnet or magnetized element 52 for the positional detection of the reel by means of a Hall-effect device as per a technique known in itself, as has been already mentioned. Said stem 51 extends in a snug fit through an elongated, arcuate slot 53 of a tab 54 which is perpendicular to ring 55 of the reel, said ring 55 having on its inner surface a toothing 56 where said pinion 50 carrying the magnetic element 52 enmeshes in such a way that by turning said stem 51 the assembly formed by the pinion and magnet can be positioned at will for the positional detection.

In this same FIG. 1 can be appreciated the existence of a lateral expansion 57 of the one-piece mounting 1, which expansion offers a bearing surface for the installation of a board 58 fastened by screws 59 screwed in holes 60, said board 58 bearing a circuit provided with a Hall-effect device for positional detection when interacting with said magnetic elements 52 when they pass through its vicinity as the reel turns.

From the above description it becomes apparent that the proposed mounting assembly allows a simple and easy adjustment both of the motor and the illumination lamp set as well as of the positional detection magnetic element with no need to dismount the reels, since the adjusting means are arranged (see FIGS. 8 and 9) in lateral zones slightly spaced from the edge of said reel 6, an independent adjustment of the motor and of the illumination lamp set with respect to said reel being also possible.

I claim:

1. A mounting assembly for reels of gaming machines whose reels bear on their edge around their periphery a translucent strip carrying various symbols and are driven by a driving motor such as a stepper motor which is angularly adjustable with respect to said reel, integrating illumination lamps within said reel which are also positionally adjustable with respect to said reel and are provided to illuminate a given number of symbols, said reel comprising:

a mounting including a hollow cylinder which has its axis in a horizontal position, is concentrically placed within said reel and has its bases at least partially open;

inside said hollow cylinder, a holder housing said motor provided to drive said reel;

first means to angularly adjust the position of said motor holder with respect to said hollow cylinder of said mounting, said means being apt to be clamped on a peripheral toothing of said hollow cylinder, the adjustment to be carried out with said means being independent from that of said illumination lamps;

a lampshade holder to hold lampshades housing said illumination lamps placed within reel, and second means to adjust the position of said lampshade holder, said adjustment being independent from that of said motor holder, said second means being apt to be clamped on a peripheral toothing of said hollow cylinder.

2. An assembly as per claim 1, wherein:

said motor holder consists in a tubular housing one of whose mouth openings is arranged in such a position that it is centered with an opening of a partially open base of said hollow cylinder; and said tubular housing being centered and guided by a cylindrical salient and being retained by a ring and having a stepped tab extending outside said cylinder in such a way that it flushingly matches an outline of a totally open mouth opening of said cylinder and projects above an edge of said totally open mouth opening, said edge having a peripheral toothing.

3. An assembly as per claim 1, wherein:

said lampshade holder which supports several lampshades is attached to a U-shaped piece through a limb thereof;

said limb extends through an arcuate slot of a wall of said hollow cylinder thereby constituting together with said wall a means for guiding and positioning said lampshade holder;

an intermediary web of said U-shaped piece being once mounted in direct contact with an inner wall of said cylinder; and a second limb of said U-shaped piece flushingly projecting above said edge of said totally open mouth opening of said cylinder at a point which is angularly offset with respect to that where said stepped tab of said motor holder emerges.

4. An assembly as per claim 3, wherein said lampshade holder consists in a plate of ring-sectorial shape with a central stub and two lateral salients with inner recesses for fastening said lampshade holder to said U-shaped piece in a snap and snug fit by means of slidingly fitting the outer end parts of inner limb portions of said U-shaped piece into said inner recesses of said lateral salients of said plate and also by means of simultaneously engaging in a snap fit said stub of said plate into a fitting hole provided in a resilient inner limb central portion of said U-shaped piece.

5. An assembly as per claim 3, wherein:

said illumination lamps are installed inside lamsphades and each of which possesses a lug formed as an extension of a bottom part with a central hole and two positioning, turn preventing stubs at each side for its fastening to said lampshade holder; said fastening being in the case of the central lampshade carried out by means of a screw passing through a hole also provided in said lampshade holder and flanked at both sides by holes provided to receive said stubs of a coincident diameter; whereas said fastening is in the case of both lateral lampshades carried out by means of screws arranged through an array of holes of said plate which are equispaced in such a way as to leave at each of both sides of said screw a corresponding free hole for insertion into them of a corresponding positioning stubs.

6. An assembly as per claim 1, wherein said first and second means to angularly adjust the position of said motor holder and to adjust the position of said lampshade holder are identical.

7. An assembly as per claim 6, wherein:

each of said first and second means comprises a locking member with a hollow to house one half of a spring whose other half is to be housed in another hollow of a second piece which has lateral recesses which are apt to loosely receive lateral salient portions of said locking member thus allowing a shifting thereof; and said second piece being fastened in the case of the motor holder to said stepped tab of said motor holder, and in the case of said lampshade holder to a limb of said U-shaped piece connected to said holder, said locking member ending at its end opposite to that of the pulling handle in a toothing which is apt to snugly engage a toothing of said hollow cylinder.

8. An assembly as per claim 1, wherein said peripheral toothing of said mouth opening of said totally open base of said hollow cylinder is one and the same and common for said first means to angularly adjust the position of said motor holder and for said second means to adjust the position of said lampshade holder, and is situated next to the edge of said totally open base of said hollow cylinder.

9. An assembly as per claim 1, wherein said mounting further comprises a vertical wall which at one of its ends is bent to thus form a lower base portion and which at its other end connects with an edge of said totally open base of said hollow cylinder which extends overhanging from said vertical wall, with reinforcing ribs to provide a stronger support for said overhanging cylinder there where it starts out from said wall.

10. An assembly as per claim 1, and further comprising:

an arrangement in association with said reel of at least a hollow pinion provided at one end with a stem and at its other end with a cavity to house a magnet or magnetized element for a positional detection of said reel by means of a Hall-effect device;

said stem extending in a snug fit through an elongated, arcuate slot of a tab which is perpendicular to a ring of said reel, said ring having on its inner surface a toothing where said pinion carrying the magnetic element enmeshes in such a way that by turning said stem the assembly formed by the pinion and magnet can be positioned at will for the positional detection and existing an element to attach said stem.

11. An assembly as per claim 1, wherein said assembly mounting is obtained in a one moulded piece provided with a lateral expansion, which expansion offers a bearing surface for the installation of a board fastened by screws screwed in holes, said board bearing a circuit provided with a Hall-effect device for positional detection when interacting with said magnetic elements when they pass through its vicinity as the reel turns.

12. An assembly as per claim 1, wherein notches have been provided in said flange of said motor holder to allow the passage therethrough of mounting lugs of said motor in order to fasten the latter by its front part by means of screwing down said lugs with the aid of holes provided in said flange, and tubular adapters have been alternatively provided to allow to fasten said motor by its rear part by means of screwing down an end plate of said motor with the aid of holes of the corresponding adapter.

* * * * *